United States Patent [19]

Premetz

[11] 4,128,863

[45] Dec. 5, 1978

[54] STOWABLE DECORATIVE LIGHTS

[75] Inventor: Michael J. Premetz, 12 Covington Rd., Yonkers, N.Y. 10710

[73] Assignee: Michael J. Premetz, Yonkers, N.Y.

[21] Appl. No.: 796,985

[22] Filed: May 16, 1977

[51] Int. Cl.[2] ..... F21S 1/00

[52] U.S. Cl. ..... 362/249; 362/145; 362/418; 362/806

[58] Field of Search ..... 362/249, 806, 252, 145, 362/147

[56] References Cited

U.S. PATENT DOCUMENTS

| | | | |
|---|---|---|---|
| 3,204,090 | 8/1965 | Kvarda | 362/249 |
| 3,278,742 | 10/1966 | Stallard | 362/806 |
| 3,569,691 | 3/1971 | Tracy | 240/10 |
| 3,692,993 | 9/1972 | Robinson | 240/9 R |

*Primary Examiner*—Samuel W. Engle
*Assistant Examiner*—Ralph Palo

[57] ABSTRACT

A string of outdoor decorative lights is connected to a facer board on a building cave. A stowable embodiment of the invention provides hinged attachment to the facer board and means for securing the string in a display position or in a hidden position. Snap-in tabs hold the string in either position.

3 Claims, 6 Drawing Figures

STOWABLE DECORATIVE LIGHTS

BACKGROUND OF THE INVENTION

It is an inconvenient and often hazardous task to annually put up and take down decorative lights in festive seasons such as Christmas. The prior art teaches lamps which withdraw into compartments as in U.S. Pat. Nos. 3,692,993; 3,569,691; and 3,836,760; and lamps which are easily installed and removed using special attachment devices as in U.S. Pat. Nos. 1,771,444; 3,204,090; and 3,341,699.

The prior art fails to teach a hinged lamp string which is foldable into display or hidden positions.

SUMMARY OF THE INVENTION

The present invention relates to strings of decorative lights of the type which are displayed in festive seasons such as Christmas.

A pair of plastic rails, each containing an electrical conductor, are separated by a semi-rigid flat plastic web. Lamp sockets are installed at intervals along the plastic web and make electrical connection to the electrical conductors. In one embodiment, the rails, web and sockets are hingeably attached to an overhanging facer board using hinges periodically spaced along the length of the string. Closely spaced openings along the web provide attachment points for one end of a member of holding tabs. The other end of the holding tabs are fastened to the building in a suitable manner to retain the hinged string either in a position that allows lamps inserted in the sockets to be seen, or alternatively, the tabs hold the string of lamps hinged into a hidden position.

A male electrical connector on one end of the string and a female electrical connector on the other end enables the end-to-end connection of a number of lamp strings to decorate an entire house using only a few feed wires.

Where an overhanging facer board is not available, the string of lamps can be firmly affixed to the surface of the building using the openings along the web to enable the entry of fasteners such as nails or screws.

DETAILED DESCRIPTION OF THE PREFERRED EMBODIMENT

Figure 1:
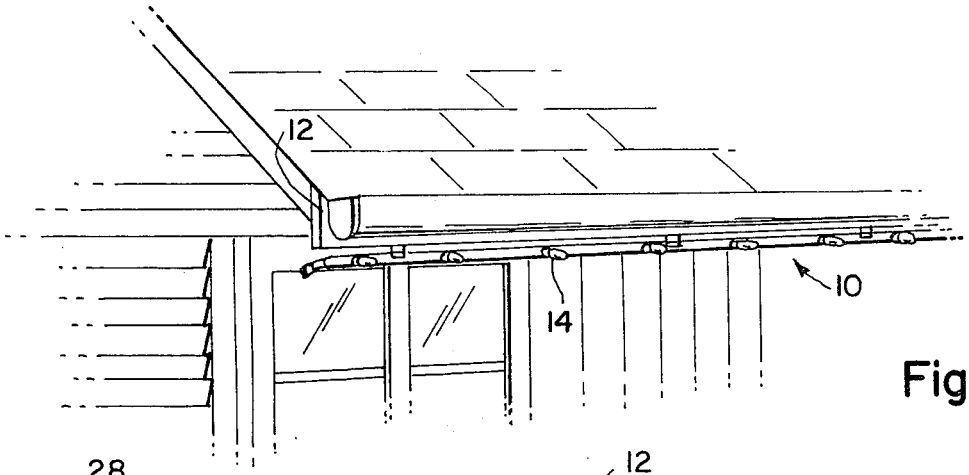
FIG. 1 shows a perspective view of a portion of a building with a string of decorative lamps of one embodiment of the invention suspended in display position from a facer board.

In FIG. 1, the string of decorative lights 10 is shown attached to the overhanging facer board 12 of a building. Lamps 14 are located at periodic intervals along the string 10.

Figure 2:
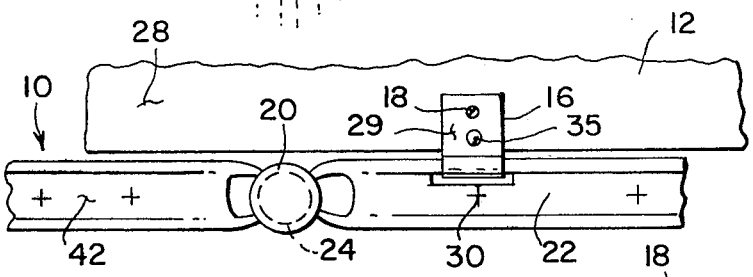
FIG. 2 shows a rear view of the invention showing the method of hinging to an overhanging facer board.
Figure 3:
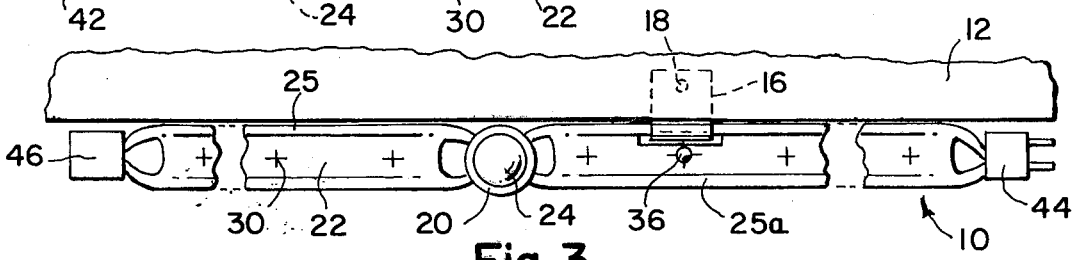
FIG. 3 shows a front view of the invention.
Figure 4:
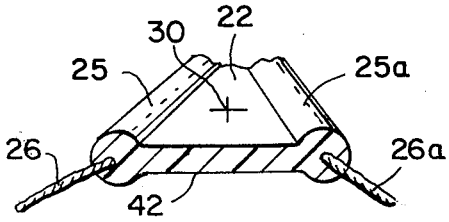
FIG. 4 shows a cutaway view of the lamp string.

Referring to FIGS. 2, 3, and 4, the string 10 is connected by a hinge 16 to the rear surface of the facer board 12 using suitable fasteners such as screws 18 or nails. A plurality of hinges 16 spaced along the length of the string is contemplated. At least two hinges 16, one near each end of the string, is contemplated to be the minimum number with best results with at least one additional hinge 16 at the center of the string 10.

A socket 20, attached to the web 22 of the string provides mechanical support and electrical connection to a decorative lamp 24. An enlargement 25, **25*a*, located at the outer edges of the web 22, contain electrical conductors 26, 26*a* embedded therein. Electrical connection between the electrical conductors 26, 26*a* and the socket 20 is made using techniques well known in the art and thus is not shown. The web 22, enlargements 25 and 25*a* with electrical conductors 26 and 26*a*** embedded therein can be made of any suitable material and by any method known in the art but are preferably continuously extruded using a suitable plastic such as polyethylene or polyvinyl chloride.

Referring now to FIG. 2, the string 10 is shown suspended just below and just forward of the rear surface 28 of the facer board 12.

In the front view of FIG. 3, the socket 20 and the lamp 24 are shown installed in the string 10. Also shown are a series of apertures 30 at close spacing along the entire length of the web 22. The apertures 30, shown here as cross shaped can be circular or elongated.

Figure 5:
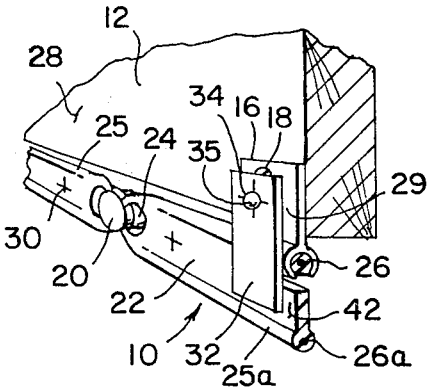
FIG. 5 shows a rear perspective view of the facer board with the lamp string supported in the display position using a holding tab.
Figure 6:
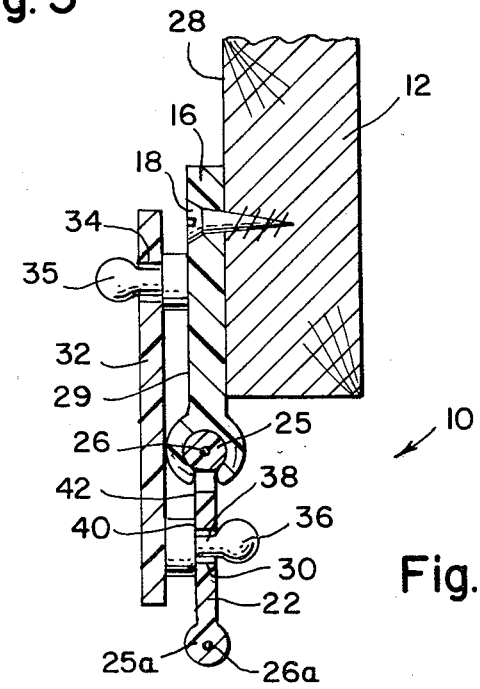
FIG. 6 shows a cross-section taken through the lamp string.

Referring to FIGS. 5 and 6, the string 10 is shown being held in its display position by a holding tab 32. The holding tab 32 overlaps part of the web 22 and the rear surface 28 of the hinge 12. The holding tab 32 is attached to the hinge 16 by engagement of an aperture 34 in the holding tab 32 with a protuberance 35 on the rear surface 29 of the hinge 16.

As shown in FIG. 6, the holding tab 32, preferably formed of suitable plastic material contains a molded protuberance 36 on a stem 38. The stem 38 and holding tab 32 are joined by a shoulder 40. The protuberance 36 is sized for a press fit through any one of the apertures 30. The rear surface 42 of the web 22 bears against the shoulder 40 and is held in close proximity thereto by the close fit of the protuberance 36 in the aperture 30. Referring to FIGS. 2, 5 and 6, it will be evident that the string 10 can be hinged into a hidden position behind the facer board 12 by removing the holding tabs 32 and rotating the string 10 until the aperture 30 may be pressed over the protuberance 35 on the hinge 16. The string 10 is then held up with the rear of the string 10 adjacent the rear of the facer board 12.

In installations where an overhanging facer board 12 is unavailable to make hidden stowage possible, the string 10 can be firmly affixed to any surface using suitable fasteners inserted through the apertures 30. If non-hinged vertical suspension of the string 10 is desired, the holding tabs 32 alone can be used behind or in front of the string 10 with suitable fasteners such as nails or screws. The holding tabs 32 can remain permanently installed from season to season and the annual installation becomes the simple task of snapping the protuberances 36 on the holding tabs 32 through the apertures 30.

Referring to FIG. 3, a male electrical connector 44 is connected at one end of the string 10 and a female electrical connector 46 is connected at the other end. Power is provided to the lamps 24 through the male electrical connector 44. The female electrical connector 46 is available to supply electrical power to another string.

It will be understood that the claims are intended to cover all changes and modifications of the preferred embodiments of the invention, herein chosen for the purpose of illustration which do not constitute departures from the spirit and scope of the invention.

What is claimed is:

1. A decorative electrical lamp display comprising: a flat plastic web; a first electrical conductor embedded in a first outer edge of said web; a second electrical conductor embedded in a second outer edge of said web; lamp sockets installed at intervals along the flat side of said plastic web sand having electrical connections with said first and second electrical conductors; said lamp sockets housing electric lights and giving the plastic web the appearance of a string of lights; said plastic web being hingeably attached to an overhanging facer board of a building; said web being attached by means of hinges, the first end of each of said hinges is fastened to the back side of said facer board while the second end of each of said hinges is hingeably attached to the plastic web; spaced openings along the web provide attachment points for the second ends of said hinges; spaced slits along the flat plastic web provide attachment means for interference fit with protuberances molded onto the backside of the hinges, allowing the string of lights to be hidden behind the facer board when not in use, by swinging the plastic web backwards and up into the protuberances through the slits which are periodicallly spaced along the the plastic web to correspond to said mating protuberances on the hinges; when said string of lights is in use the web is held in place by means of at least one holding tab comprising a member with a protuberance at one end adapted to interference fit with a slit on the plastic web and a slit on the opposite end adapted to interference fit with a protuberance on the backside of the hinge.

2. The lamp display recited in claim 1 further comprising a male electrical connector in electrical contact with said first and second electrical conductors.

3. The lamp display in claim 2 further comprising a female electrical connector at the other end of said first and second electrical conductors.

* * * * *